US012791290B2

(12) United States Patent
Bowden-Peters

(10) Patent No.: US 12,791,290 B2
(45) Date of Patent: Nov. 10, 2026

(54) COUNTERMEASURE

(71) Applicant: MBDA UK LIMITED, Hertfordshire (GB)

(72) Inventor: Edwin Bowden-Peters, Hertfordshire (GB)

(73) Assignee: MBDA UK LIMITED, Hertfordshire (GB)

( * ) Notice: Subject to any disclaimer, the term of this patent is extended or adjusted under 35 U.S.C. 154(b) by 0 days.

(21) Appl. No.: 19/166,378

(22) PCT Filed: Apr. 2, 2024

(86) PCT No.: PCT/GB2024/050901
§ 371 (c)(1),
(2) Date: Sep. 17, 2025

(87) PCT Pub. No.: WO2024/209199
PCT Pub. Date: Oct. 10, 2024

(65) Prior Publication Data

US 2026/0266583 A1 Sep. 10, 2026

(30) Foreign Application Priority Data

Apr. 3, 2023 (GB) ..... 2304912

(51) Int. Cl.
*F41H 11/02* (2006.01)
*F42B 7/08* (2006.01)
*F42B 12/50* (2006.01)

(52) U.S. Cl.
CPC ..... *F41H 11/02* (2013.01); *F42B 7/08* (2013.01); *F42B 12/50* (2013.01)

(58) Field of Classification Search
CPC ..... F41H 11/02; F42B 12/56; F42B 12/44; F42B 12/46; F42B 7/08; F42B 12/50
See application file for complete search history.

(56) References Cited

U.S. PATENT DOCUMENTS 4,408,535 A 10/1983 Alford
7,207,276 B1 * 4/2007 Dindl ..... F42B 5/02 102/443

(Continued)

FOREIGN PATENT DOCUMENTS

CZ 2005488 A3 2/2007
EP 3907463 A1 11/2021

(Continued)

OTHER PUBLICATIONS

EP Communication corresponding to Application No. 20800256.8, dated Mar. 13, 2024, 12 pages.

(Continued)

*Primary Examiner* — Michael D David
(74) *Attorney, Agent, or Firm* — Day Pitney LLP; George Chaclas; Joseph P. Quinn

(57) ABSTRACT

A method for disrupting the operation of a system comprising electrical and/or electronic circuitry is disclosed. The method comprises the steps of firing a cartridge containing ferrite powder from a gun. The ferrite powder forms a kinetic-effect column that penetrates the system thereby causing physical damage. The ferrite powder then disperses within the system to disrupt operation of the electrical and/or electronic circuitry. A cartridge and kit for use in such a method is also disclosed.

20 Claims, 5 Drawing Sheets

(56) References Cited

U.S. PATENT DOCUMENTS

| | | | | |
|---|---|---|---|---|
| 7,503,260 | B2 * | 3/2009 | Kapeles | F42B 5/02 102/444 |
| 9,163,914 | B2 * | 10/2015 | Carton | B26F 3/04 |
| 10,139,204 | B2 * | 11/2018 | Naud | F42B 33/04 |
| 2005/0066841 | A1 * | 3/2005 | Vasel | F42B 12/50 102/502 |
| 2008/0017064 | A1 * | 1/2008 | Kapeles | F42B 30/02 102/444 |
| 2017/0261292 | A1 | 9/2017 | Armstrong et al. | |
| 2018/0103036 | A1 | 4/2018 | Fox et al. | |
| 2020/0001369 | A1 | 1/2020 | Nakaseko et al. | |
| 2022/0026179 | A1 | 1/2022 | Kolanek et al. | |
| 2022/0390216 | A1 | 12/2022 | Hamnett | |

FOREIGN PATENT DOCUMENTS

| | | | |
|---|---|---|---|
| WO | 2007099359 | A1 | 9/2007 |
| WO | 2019074573 | | 4/2019 |

OTHER PUBLICATIONS

GB Search Report corresponding to Application No. 1915500.1, dated Apr. 20, 2020, 3 pages.
GB Search Report corresponding to Application No. 2304912.5, dated Oct. 9, 2023, 3 pages.
International Search Report and Written Opinion corresponding to Application No. PCT/GB2020/052661, dated Feb. 9, 2021, 8 pages.
International Search Report and Written Opinion corresponding to Application No. PCT/GB2024/050901, dated Jun. 28, 2024, 13 pages.

* cited by examiner

COUNTERMEASURE

CROSS-REFERENCE TO RELATED APPLICATIONS

The present application is a U.S. National Stage Application of International Application No. PCT/GB2024/050901 filed on Apr. 2, 2024, which claims the benefit and priority of Great Britain Patent Application No. GB2304912.5 filed on Apr. 3, 2023, each of which is incorporated herein by reference in its entirety for any purpose whatsoever.

FIELD OF THE DISCLOSURE

The present disclosure concerns countermeasures for use against systems comprising electrical and/or electronic circuitry, for example Uncrewed Air Systems (UAS). More particularly, but not exclusively, this disclosure concerns a method for disrupting the operation of a system comprising electrical and/or electronic circuitry using a cartridge containing ferrite powder, a cartridge containing ferrite powder, and a kit comprising such a cartridge.

BACKGROUND OF THE DISCLOSURE

UAS are typically propelled by electric motors, often brushless DC motors, for example arranged to drive a propeller. In ground vehicles (crewed or uncrewed), an electric motor may drive the wheels or tracks. UAS, ground vehicles and other systems may also include other electrical and/or electronic circuitry that is critical to the operation of the system, for example control systems, guidance systems, sensors, communication systems and so on.

It would be advantageous to provide more effective countermeasures than are currently available for use against such systems, and particularly, for use against UAS. UAS have taken on increased tactical importance recently and may pose particular challenges when it comes to providing effective countermeasures due to their manoeuvrability and because they are often used in urban and/or populated areas where there is a higher risk of collateral damage.

Further there is a recent trend of using larger numbers of lower cost and/or less complex UAS (e.g. commercially available drones). It would be advantageous to provide mechanically simpler and/or more cost effective countermeasures for use against such systems.

WO 2021/079123 (MBDA UK LIMITED) describes a countermeasure for use against vehicles having an electric motor comprising at least one magnet. The countermeasure comprises an ejection system comprising a plurality of pieces of magnetic material. In use, in response to the receipt of a trigger signal, the ejection system releases the plurality of pieces of magnetic material, some of which are attracted to the magnet of the motor, stick to the magnet and thereby obstruct the motor. The countermeasure described in WO 2021/079123 is effective while being mechanically simple and cost effective. However, it would be advantageous to provide more effective countermeasures without significantly increasing the mechanical complexity and/or cost.

The present disclosure seeks to mitigate the above-mentioned problems. Alternatively or additionally, the present disclosure seeks to provide an improved countermeasure for use against systems including electrical and/or electronic circuitry.

SUMMARY

The present disclosure provides, according to a first aspect, a method for disrupting the operation of a system comprising electrical and/or electronic circuitry. The method may comprise firing a cartridge containing ferrite powder from a gun. The method may then comprise, the ferrite powder penetrates the system thereby causing physical damage. It may be the ferrite powder forms a kinetic-effect column that penetrates the system thereby causing physical damage. The method may then comprise, the ferrite powder disperses within the system to disrupt operation of the electrical and/or electronic circuitry.

Thus, methods and cartridges in accordance with the present disclosure may provide multi-effect countermeasures in which the ferrite powder is used to produce at least two, different, effects on the system being targeted. A first effect is a kinetic effect in which the ferrite powder acts as a projectile to penetrate a system. As used herein, the term 'penetrates' refers to entering by damaging a system. For example by fracturing, piercing or otherwise damaging a system, for example a housing or shield of a system. A second effect is an electrical effect in which the ferrite powder disrupts the electrical and/or electronic circuitry of a system. Disrupting operation of the electrical and/or electronic circuitry may comprise the ferrite powder shorting the electrical and/or electronic circuitry, for example when it settles on a circuit board or other circuitry. Disrupting operation of the electrical and/or electronic circuitry may comprise ferrite powder being magnetically attracted into an electric motor of the system and thereby disrupting operation of the motor. Such multi-effect methods and countermeasures may provide increased efficacy (likelihood of successfully rendering the targeted system non-operational) due to the combination of the two different effects. Further, the use of ferrite powders in a cartridge may allow such effects to be produced in a mechanically simple, robust and cost-effective manner.

Surprisingly, the applicant has found that a kinetic effect column is achieved when ferrite powder is used in an appropriate, but otherwise conventional, cartridge. That is to say, that, for example, while not all shot gun cartridges will inevitably produce a kinetic-effect column many conventional cartridge designs do, and the skilled person will be able to select an appropriate design using their skill in the art and without undue burden. It will be apparent that some minor adjustments may be required for, e.g. a shotgun shell containing shot to be used with a powder, for example ensuring a tight enough seal on the crimp so that the (smaller) powder doesn't fall out and/or adjusting the amount of propellant, but these will be apparent to the skilled person and form part of a routine design process for any cartridge. Where it is desirable to increase the range at which the kinetic effect column is effective, a wad may be used, but this is not essential particularly where a short-range kinetic effect is desired.

The cartridge is shaped and configured appropriately to provide the kinetic-effect column. Methods for constructing cartridges capable of producing such a kinetic-effect column will be well known to the skilled person, and this effect can be achieved in various different ways. The inventors have recognized that by using ferrite powder in such cartridges a multi-effect countermeasure for use against systems comprising electrical and/or electronic circuitry, particularly UAS, may be provided.

As used herein, ferrite refers to ferrimagnetic material derived from iron oxide. It may be that the ferrite powder comprises, essentially consists of, or consists of, ferrite particles having a diameter equal to or less than 0.4 mm. For example, ferrite particles having diameters in the range of from 0.85 mm to 0.1 mm inclusive of both end values, for example from 0.4 mm to 0.1 mm, inclusive of both end values.

It may be that the ferrite powder is soft-magnetic ferrite powder. A soft-magnetic ferrite powder comprises, essentially consists of, or consists of, soft-magnetic ferrite material. That is to say, ferrite material that is soft-magnetic as opposed to hard-magnetic. The soft-magnetic ferrite may be manganese-zinc (MnZn) ferrite or nickel-zinc (NiZn) ferrite. Soft-magnetic ferrite may increase the efficacy of the cartridges as such materials are strongly attracted to magnets, thereby assisting in dispersal of the powder within the system and/or accumulation of the powder in a motor of the system, while soft-magnetic ferrite does not itself become magnetized, thereby reducing the risk of the powder clumping (and the increased risk of collateral damage).

The kinetic-effect column may be a mass of ferrite powder having a (substantially) planar front face, the front face being the face of the mass of the opposite side of the mass to a muzzle of the gun from which the cartridge has been fired. The mass of ferrite powder may be (substantially) cylindrical.

It may be that the cartridge is fired from a gun, for example in response to a trigger signal. The trigger signal may be a mechanical trigger signal, for example a user manually operating a trigger of the gun (e.g. pulling the trigger). The trigger signal may be an electronic trigger signal, for example a trigger signal received from a control system.

It may be that the kinetic-effect column penetrates the system at a distance of at least 2 meters, for example at least 5 meters from a muzzle of the gun. It may be that the kinetic-effect column penetrates the system at a distance of from 2 meters to 10 meters, inclusive of both end values.

It may be that, in the case that the kinetic-effect column does not penetrate the system and/or misses the system, the ferrite powder disperses. It may be that the powder disperses as a non-lethal cloud. A non-lethal cloud may be defined as the particles being spatially distributed and/or having levels of kinetic energy such that there is substantially no risk of causing impact injury to a human. Thus, it may be that ferrite powder from the cartridge forms a kinetic-effect column that penetrates the system thereby causing physical damage and then disperses within the system to disrupt operation of the electrical and/or electronic circuitry, or, in the case that the kinetic-effect column misses the system, the ferrite powder disperses as a non-lethal cloud. Thus, methods and countermeasures in accordance with the present disclosure may be more effective than prior-art systems while reducing the risk of collateral damage. Without wishing to be bound by theory, it is believed that the use of a powder means that each individual particle has a relatively low mass thereby facilitating the dispersal of the particles to form a non-lethal cloud with increasing distance from the muzzle.

It may be that the ferrite powder is in the form of a kinetic-effect column at a first predetermined distance from a muzzle of the gun. It may be that the first predetermined distance is at least 2 meters, for example at least 5 meters. It may be that the first predetermined distance is from 2 meters to 10 meters (inclusive of both end points). A predetermined distance may be the straight-line distance as measured from the muzzle of the gun from which the cartridge is fired.

It may be that the ferrite powder of the kinetic-effect column disperses to form a non-lethal cloud at a point beyond said first predetermined distance. It may be that said point beyond said first predetermined distance is at a second, greater, predetermined distance, from the muzzle. For example, the second predetermined distance may be at least 10 meters, for example from 10 meters to 12 meters inclusive of both end values.

The electrical and/or electronic circuitry may comprise at least one magnet and/or at least one component that produces a magnetic field when a current flows through it. It may be that the ferrite powder is magnetically attracted to the electrical and/or electronic circuitry. It may be that, once dispersed, the ferrite powder is attracted to the magnet and/or the magnetic field produced by said component. The electric and/or electronic circuitry may comprise an electric motor and/or a circuit board. The electric motor may comprise a rotor, a stator, and an air gap between the rotor and the stator. The magnet may be located on the rotor and/or the stator. It may be that the ferrite powder, once dispersed, is magnetically attracted to the magnet in the electric motor and may therefore be attracted into the motor. The ferrite powder may then accumulate on the magnet and thereby disrupt operation of the motor. This may provide a mechanically simple and cost effective way of disrupting the operation of a vehicle with an electric motor. The ferrite powder may obstruct the motor by at least partially filling the air gap. The ferrite powder may entirely block the motor, such that the rotor can no longer rotate. Alternatively, the ferrite powder may inhibit rotation of the motor, such that the rotor may still rotate but only at a reduced speed. The electric motor may comprise one of an AC motor, a DC motor, a brushless AC motor, a brushless DC motor and a permanent-magnet synchronous motor.

It may be that the cartridge comprises and/or contains one or more reactive agents, for example mixed with the ferrite powder. It may be that said one or more reactive agents are ignited on firing and/or on impact with the system and thereby provide a pyrotechnic effect. Inclusion of such a reactive agent may further increase the efficacy of the present methods and countermeasures by providing a pyrotechnic effect in addition to the kinetic effect and the electrical effect. It may be that, on impact, rapid deceleration of the particles in the kinetic effect column causes heating of the reactive agents which ignites them, thereby providing pyrotechnic effects. It may be that on firing, the reactive agents are ignited within the barrel. In the case that a reactive agent is ignited on firing, the pyrotechnic effect may endure as the reactive agent and ferrite powder penetrates the system and/or disperses within the system. Additionally and/or alternatively, the reactive agent may assist with targeting of the system as said pyrotechnic effect provides illumination visible to an operator of the countermeasure. It may be that the method comprises aiming and firing a first cartridge at a system, and then aiming a second cartridge at the same system in dependence on a light effect produced by magnesium in the first cartridge, and then firing the second cartridge. It may be that the reactive agent is ignited on impact, and the pyrotechnic effect takes place as the reactive agent and ferrite powder penetrates the system and/or disperses within the system.

Said reactive agents may be in powder form, for example powder comprising particles diameters within the same range as the ferrite powder. For example, particles having a diameter equal to or less than 0.4 mm. For example, particles having diameters in the range of from 0.4 mm to 0.1 mm, inclusive of both end values. Said reactive agents may be ejected from the gun along with the ferrite powder. Said reactive agents may form part of the kinetic effect column. Said reactive agents may reach a target system, or first predetermined distance, at the same time as the ferrite powder or shortly before or after the ferrite powder.

It may be that said one or more reactive agents is magnesium. Thus, it may be that the cartridge comprises magnesium, for example mixed with the ferrite powder. It may be that, on firing, said magnesium is ignited and thereby provides a pyrotechnic effect.

It may be that said one or more reactive agents is aluminium and/or zirconium. Thus, it may be that the cartridge comprises aluminium and/or zirconium, for example mixed with the ferrite powder. It may be that, on impact with the system, said aluminium and/or zirconium is ignited and thereby provides a pyrotechnic effect.

It may be that the cartridge comprises and/or contains coloured particles, for example dyes and/or paints, mixed with the ferrite powder. It may be that said coloured particles leave a mark on the system as the ferrite powder penetrates the system and/or disperses within the system. Inclusion of such coloured particles may assist in identification of a system after it has been shot down using the methods and/or countermeasures of the present disclosure. Thus, the method may comprise identifying a system in dependence on a coloured marking made on the system by the coloured particles.

The system comprising the electric and/or electronic circuitry may be an aircraft. The aircraft may be a rotary wing aircraft, for example a quadcopter, or a fixed wing aircraft. The aircraft may be a UAS, for example a class 1 UAS or a class 2 UAS. The UAS may have a mass of at least 9 kg. The UAS may have a mass of less than 25 kg. The UAS may have a mass of at least 1 kg.

It may be that the cartridge is within a barrel of a gun at the start of the method. The method may comprise the gun being fired, for example in response to the trigger signal.

It may be that firing of the gun comprises detonating a primer of the cartridge. It may be that firing of the gun comprises igniting a propellant of the cartridge. For example, it may be that detonation of the primer causes ignition of the propellant. It may be that firing of the gun, for example ignition of the propellant, causes the cartridge (or parts thereof, for example the wad (if present) and the ferrite powder) to accelerate along a barrel of the gun. It may be that the ferrite powder is then ejected from a muzzle of the gun.

It may be that the wad (if present) remains with (travels with) the ferrite powder after the ferrite powder leaves the barrel of the gun. This may assist in the ferrite powder forming and/maintaining the kinetic effect column, particularly at longer ranges. For example, it may be that the wad remains with the ferrite powder at least until the ferrite powder impacts the system. It may be that the shape and/or configuration of the wad remains the same while the wad is in flight (e.g. throughout the period from exiting the barrel to impacting the system). It may be that the shape and/or configuration of the wad remains the same as between travel along the barrel of the gun and while the wad is in flight. It may be that sidewall(s) and/or any part(s) thereof, do not move relative to the base of the wad while the wad is flight. Thus, it may be that the sidewall(s) remain in their original position with respect to the base despite the airflow over the wad while it is in flight. It may be that the wad remains with the powder and/or the shape and/or configuration of the wad remains the same, for a distance of at least 2 meters, for example at least 5 meters from the muzzle of the gun.

In a second aspect of the disclosure, there is provided a cartridge, the cartridge containing ferrite powder. It may be that the cartridge is configured such that when fired from the muzzle of a gun, the cartridge produces, at a first predetermined distance from the muzzle, a kinetic-effect column of the ferrite powder for penetrating a system; and then at a point beyond said first predetermined distance the ferrite powder disperses as a non-lethal cloud.

Thus, the cartridges initially provide a kinetic-effect column which thereafter (with increasing time and/or distance) disperses as a non-lethal cloud. In the case that the kinetic-effect column has penetrated a system, the ferrite powder can disrupt the operation of electrical and/or electronic circuitry as described above. However, in the case that the kinetic-effect column has not penetrated a system, for example because it has missed the targeted system, the risk of collateral damage is reduced because the ferrite powder can disperse, for example in a way discrete projectiles, including frangible projectiles, cannot.

It may be that the ferrite powder is in a particulate form within the cartridge. It may be that the ferrite powder is not bound together within the cartridge. It may be that the ferrite powder is loose within the cartridge. That is to say, the ferrite powder does not form a discrete projectile, for example a frangible projectile. For example, the ferrite powder is not bound with a binder such as wax or sintered together to form a single body.

As used herein, the term cartridge refers to pre-assembled ammunition suitable for use with a gun having a barrel. The term 'shell' is a synonym of cartridge as used herein.

It may be that the cartridge is a shotgun cartridge, for example a .410 or 12 gauge cartridge. For example, the cartridge may be configured to be received in the barrel of a shotgun and be fired thereby. Thus, the gun may be a shotgun. It may be that the cartridge is suitable for use with a cannon or other larger guns.

It may be that the cartridge is a grenade-launcher cartridge (sometimes referred to as a 40 mm grenade). Thus, the gun may be a grenade launcher.

It may be that the cartridge is (substantially) cylindrical, for example closed at both ends. It may be that the cartridge is closed at one end (a first end), for example using a crimp closure, a rolled turnover or some other closure.

The cartridge may comprise a case, for example containing the ferrite powder. The case may be closed at the first end as described above. The case may be paper or plastic or some other suitable material. The case may package the other elements of the cartridge (e.g. the ferrite powder, the wad (if present), the primer (if present), the propellant (if present), the sabot (if present) and/or any other packaging material). Thus, the case may define a cavity within which the other elements of the cartridge are assembled.

The cartridge may comprise a propellant, for example within the case. The cartridge may be configured such that when the propellant is ignited the propellant propels the cartridge along the barrel of the gun. The propellant may be located in, for example form a layer across, a first end of the cartridge. The ferrite powder may be located at, for example form a layer across, a second end of the cartridge, opposite the first end of the cartridge.

The cartridge may comprise a wad, for example within the case. It may be that the wad separates the ferrite powder from the propellant. The cartridge may be configured such that when it ignites, the propellant pushes the wad and the ferrite powder along the barrel. The cartridge may be configured such that the wad is ejected from the muzzle along with the ferrite power. The wad may be a fibre wad. The wad may be a plastic wad. The wad may comprise a base, for example adjacent the propellant. The wad may comprise one or more sidewalls. It may be that each sidewall is connected to the base at one end. It may be that each sidewall extends in a direction substantially parallel to the longitudinal axis of the cartridge, for example away from the propellant. The wad, for example the sidewall(s), may at least partially surround the ferrite powder in the cartridge. The wad may be of a single-piece construction. Without wishing to be bound by theory, it is believed that use of an appropriately shaped wad may assist in increasing the range at which the ferrite powder can penetrate a system, and thereby increasing the efficacy of the cartridge. The wad may be a disc-shaped body. The wad may be a cup-shaped body.

The wad may be configured to maintain substantially the same shape and/or configuration throughout flight, e.g. from exiting the barrel to impacting the system. The wad may be configured to maintain substantially the same shape and/or configuration throughout flight throughout flight and travel along the barrel of the gun. For example, the wad may be configured such that the or each sidewall and/or parts thereof, do not move relative to the base during (e.g. throughout) flight of the wad. It may be that the wad comprises a single continuous sidewall defining a volume in which the powder is received and/or a plurality of sidewalls with sufficient interconnection such that the or each sidewall and/or parts thereof, do not move relative to the base during (e.g. throughout) flight of the wad. It may be that the wad comprises a base and a sidewall extending around the whole of the perimeter of the base so as to define a volume in which the ferrite powder is received. Thus, the wad may be a cup-shaped body. It may be that the sidewall is continuous and, optionally, of continuous thickness around the perimeter of the base. It may be that the sidewall(s) do not have any slots extending along a portion of the length of the sidewall(s). This is in contrast to other forms of wad which may contain slots in the sidewall and/or discontinuous side-walls such that airflow past the wad causes the sidewall(s) to open in flight thereby increasing drag and causing the wad to fall away almost immediately.

The cartridge may comprise a primer. The primer may extend through the case of the cartridge. The cartridge may be configured such that detonation of the primer ignites the propellant. The primer may extend through a first end of the cartridge, for example a first end of the case.

The cartridge may comprise a sabot, for example within the case. The sabot may at least partially surround the ferrite powder in the cartridge. The sabot may comprise one or more panels. It may be that each panel extends in a direction substantially parallel to the longitudinal axis of the cartridge, and around a portion of the circumference of the cartridge. The panel(s) may at least partially surround the ferrite powder in the cartridge. The cartridge may be configured such that the sabot is ejected from the muzzle along with the ferrite power. Without wishing to be bound by theory, it is believed that use of an appropriately shaped sabot may assist in increasing the first predetermined distance (i.e. the range at which the ferrite powder can penetrate a target system), and thereby increasing the efficacy of the cartridge.

The ferrite powder may be received within a recess defined by the wad and/or the sabot. The recess may be defined (at least in part) by the base, the sidewall(s) of the wad and/or the panel(s) of the sabot. There may be gaps between the sidewalls of the wad defining the recess.

It may be that, in the cartridge, e.g. in the wad, the powder is tamped. The degree of tamping is not of particular importance, providing the powder is evenly tamped. It may be that the centre of mass of the volume of powder in the cartridge is located at the geometric centre of the volume. For example, in the case of an inhomogeneous ferrite powder, it may be that the distribution of powder is arranged so as to provide the centre of mass at the geometric centre. This may reduce the risk of the powder volume spinning in flight, and thereby dispersing.

According to a third aspect of the disclosure there is also provided a kit for use in disrupting the operation of a system comprising electrical and/or electronic circuitry. The kit may comprise a gun comprising a barrel. The kit may comprise a cartridge in accordance with the second aspect and/or suitable for use as the cartridge of the first aspect, and being suitable for firing from the barrel of the gun.

The gun may be configured to detonate the primer of the cartridge when the gun is fired. For example the gun may comprise a firing pin configured to detonate the primer, for example in response to a trigger signal.

The gun may comprise a barrel. The barrel may have a muzzle at a first end. The barrel may have a second end opposite the first end. The barrel may have a chamber adjacent the second end. The barrel may have a bore. The bore may have a diameter. The diameter of the bore may vary with distance along the length of the barrel. The diameter of the bore may decrease with distance along the length of the barrel from the second end towards the first end. Varying the diameter of the bore in this way may facilitate provision of the kinetic-effect column. For example, varying the diameter of the bore may provide an additional way of controlling distribution of ferrite powder on exit from the muzzle and/or increase the first predetermined distance.

It will of course be appreciated that features described in relation to one aspect of the present disclosure may be incorporated into other aspects of the present disclosure. For example, the method of the disclosure may incorporate any of the features described with reference to the apparatus of the disclosure and vice versa.

DESCRIPTION OF THE DRAWINGS

Embodiments of the present disclosure will now be described by way of example only with reference to the accompanying schematic drawings of which.

DETAILED DESCRIPTION

Figure 1:
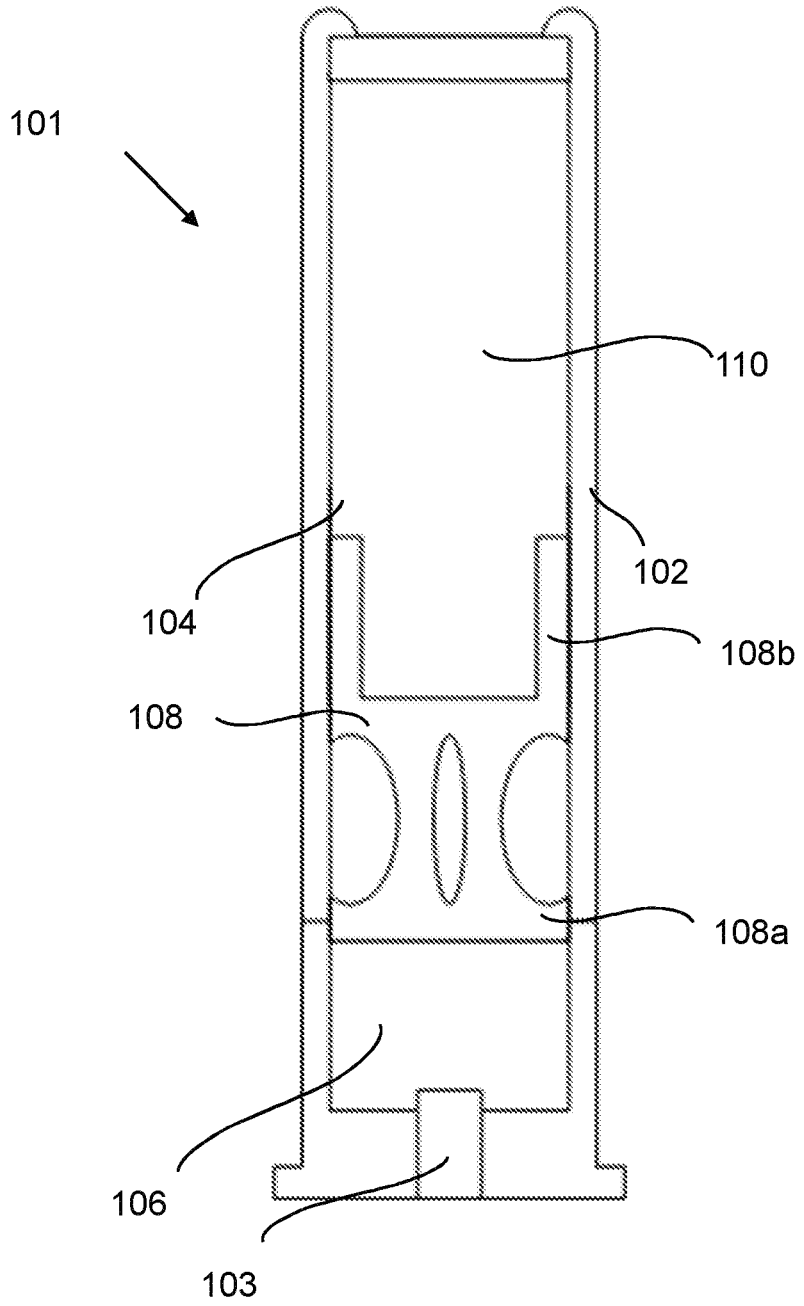
FIG. 1 shows a cross-sectional view of a cartridge according to a first embodiment of the disclosure.

FIG. 1 shows a cross-section through a shotgun cartridge 101 in accordance with a first example embodiment. The cartridge 101 comprises a casing 102 having a conventional shape and construction and which defines an interior cavity 104. At the lower end of the casing 102 in FIG. 1 a primer 103 extends through the casing to the interior cavity 104. A layer of propellant 106 is located in the lower end of the interior cavity 104. A plastic wad 108 sits atop the propellant 106. In FIG. 1 the wad 108 is shown as having a cup-like form in which the ferrite powder 110 is received. Wad 108 comprises a base **108*a* extending across the diameter of the interior cavity 104, and side walls 108*b* extending away from the base 108*a* along the longitudinal axis of the cartridge 101 and towards the upper end of the cartridge in FIG. 1. In other embodiments, the wad may have a disk-like shape, and simply comprise a flat disc extending across the diameter of the interior cavity. It yet further embodiments, the wad may have other, different, forms as will be well known to the skilled person. In the same or yet further embodiments the wad may be a fibre, cardboard or cork wad. In yet further embodiments, a sabot and disc-like wad may be used in place of the cup-like wad of FIG. 1. In some embodiments ferrite powder 110 is formed of soft-magnetic ferrite particles having diameters in the range of 0.4 mm to 0.1 mm inclusive, for example manganese-zinc (MnZn) ferrite or nickel-zinc (NiZn) ferrite particles. The top of the cartridge is closed using a rolled turnover 109. In some embodiments, a card may be located atop the ferrite powder 110 immediately below the rolled turnover 109 to assist in retaining the ferrite powder 110 within the cartridge. In some embodiments an over-powder card may be located between the wad 108 and propellant 106 and/or an under-shot card may located between the wad 108 and the ferrite powder 110**.

Optionally, the cartridge contains magnesium particles, mixed in with the ferrite powder 110. The inclusion of magnesium particles may provide increased efficacy by providing pyrotechnic effects in addition to kinetic and electrical effects and/or may improve efficacy by providing light to assist targeting.

Optionally, the cartridge contains coloured particles, for example dyes, mixed in with the ferrite powder 110. The inclusion of coloured particles may assist with identification of a system, e.g. UAS, if recovered and thereby confirming that a previously-targeted system was effectively disabled.

Optionally, the cartridge contains reactive elements such as aluminium or zirconium mixed with the ferrite powder 110. On contact with a target system, rapid deceleration of the particles in the kinetic effect column may cause heating of the reactive elements which ignites them, thereby providing pyrotechnic effects in addition to kinetic and electrical effects.

Figure 2:
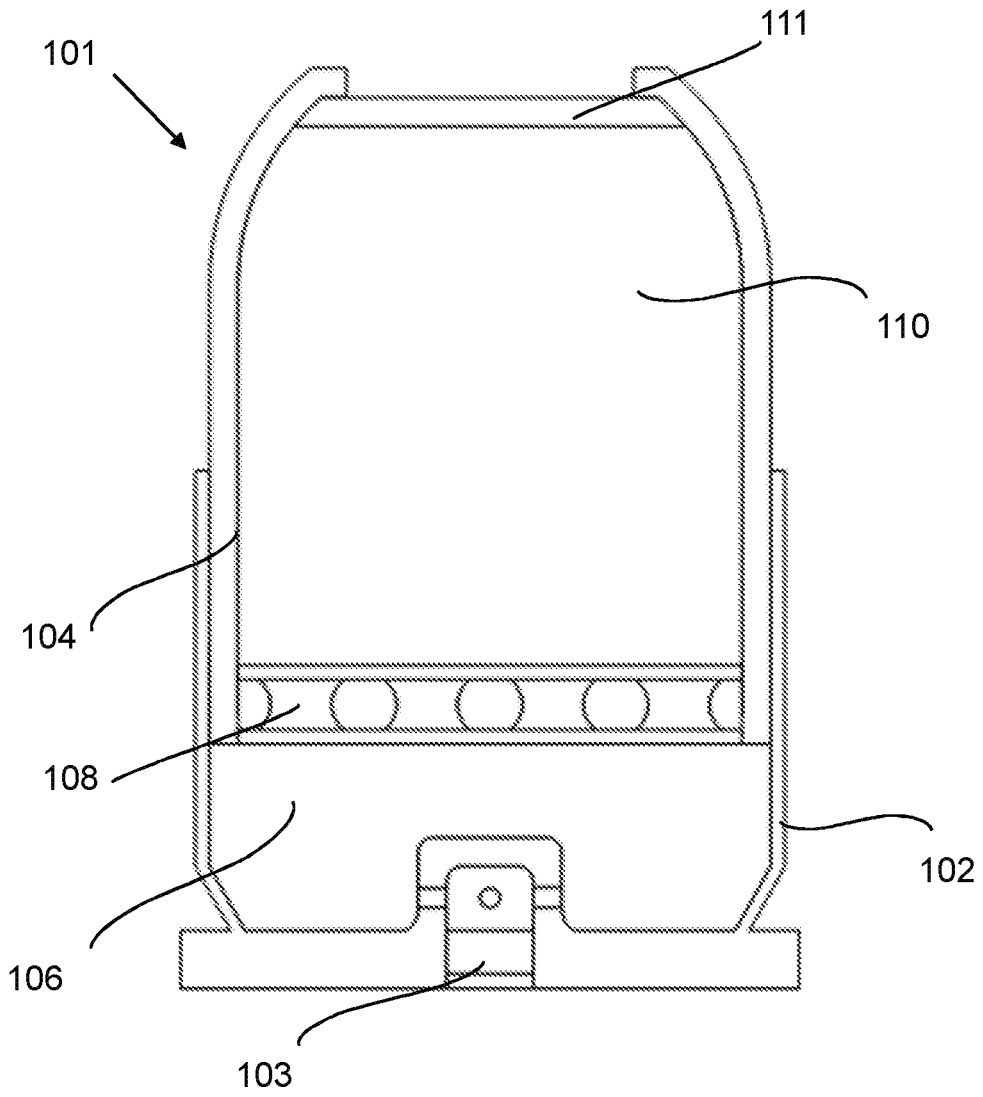
FIG. 2 shows a cross-sectional view of a cartridge according to a second embodiment of the disclosure.

FIG. 2 shows a cross-section through a grenade-launcher cartridge 101 (i.e. a 40 mm cartridge) in accordance with a second example embodiment. Like reference numerals denote like elements as between FIGS. 1 and 2, for example reference 102 denotes the casing of both cartridges. Only those aspects of the FIG. 2 embodiment which differ with respect to the embodiment of FIG. 1 will be discussed here. In comparison to the shotgun cartridge of FIG. 1, the casing 102 of the grenade-launcher cartridge of FIG. 2 is squatter but otherwise many of the same elements are present in the cartridge albeit in slightly different forms. In contrast to the cartridge of FIG. 1, in FIG. 2, the wad 108 is a flat disc. A card 111 located atop the ferrite powder 110 closes off the upper end of the casing 102.

Figure 3:
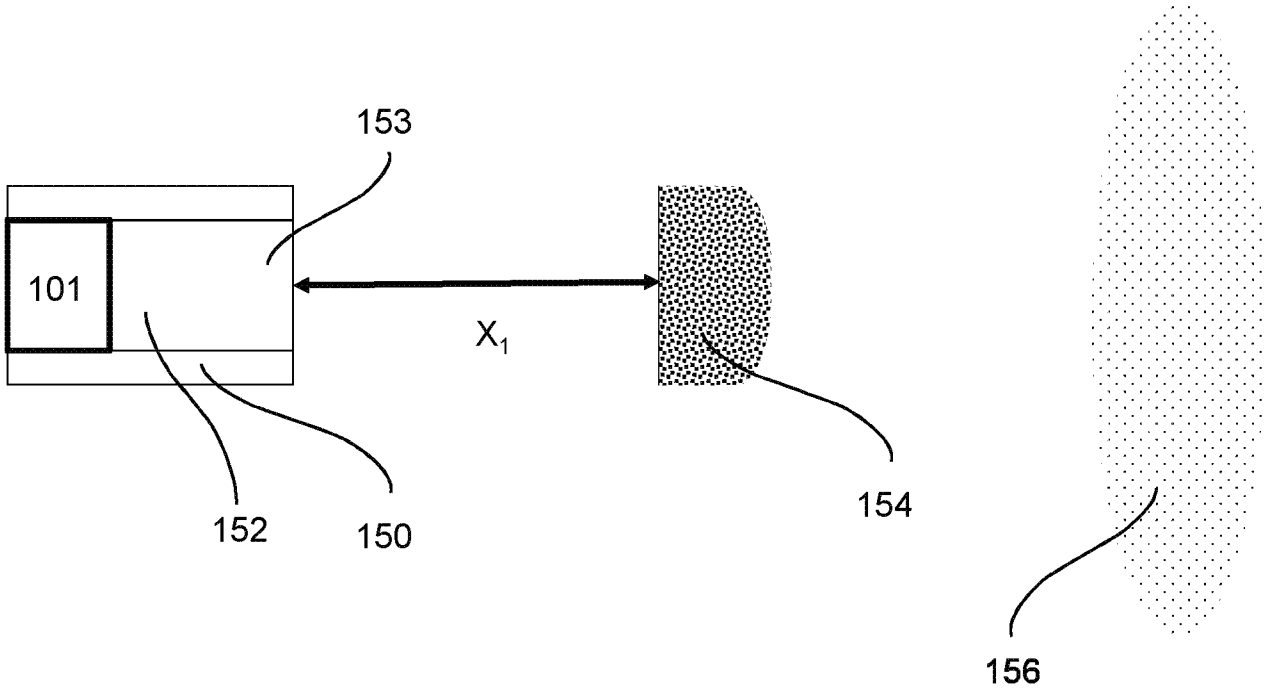
FIG. 3 shows a schematic view of a cartridge in accordance with the present disclosure in use.

FIG. 3 shows a schematic illustration of the cartridge 101 in use. Cartridge 101 is initially located in the chamber of a barrel 150 of a gun (not shown). The barrel 150 has a bore 152, and a muzzle 153 from which the ferrite powder 110 is ejected when the gun is fired. When the gun is fired the wad 108 and ferrite powder 110 are thereby ejected from the end of the barrel. At a distance, $X_1$ from the muzzle, the ferrite powder 110 is in the form of a kinetic effect column 154. The kinetic-effect column 154 is a compact and substantially cylindrical mass of ferrite powder 110 having a substantially flat face. If, as shown in FIG. 3, the kinetic-effect column 154 does not encounter any other object (e.g. a target system) then the ferrite powder 110 forming kinetic-effect column 154 disperses to form a non-lethal cloud 156. In the non-lethal cloud 156 the ferrite powder 110 is significantly more dispersed in comparison to the kinetic-effect column and is travelling at a much lower velocity such that there is substantially no risk of the ferrite powder 110 in the non-lethal cloud 156 causing injury to a human. The wad (not shown in FIG. 3) detaches from the powder after it leaves the barrel, but before it reaches the distance $X_1$. In some embodiments, $X_1$ is in the range from 2 meters to 10 meters. In other embodiments, the wad (not shown in FIG. 3) remains with, and assists in maintaining the form of, the kinetic-effect column 154 beyond $X_1$.

Figure 4:
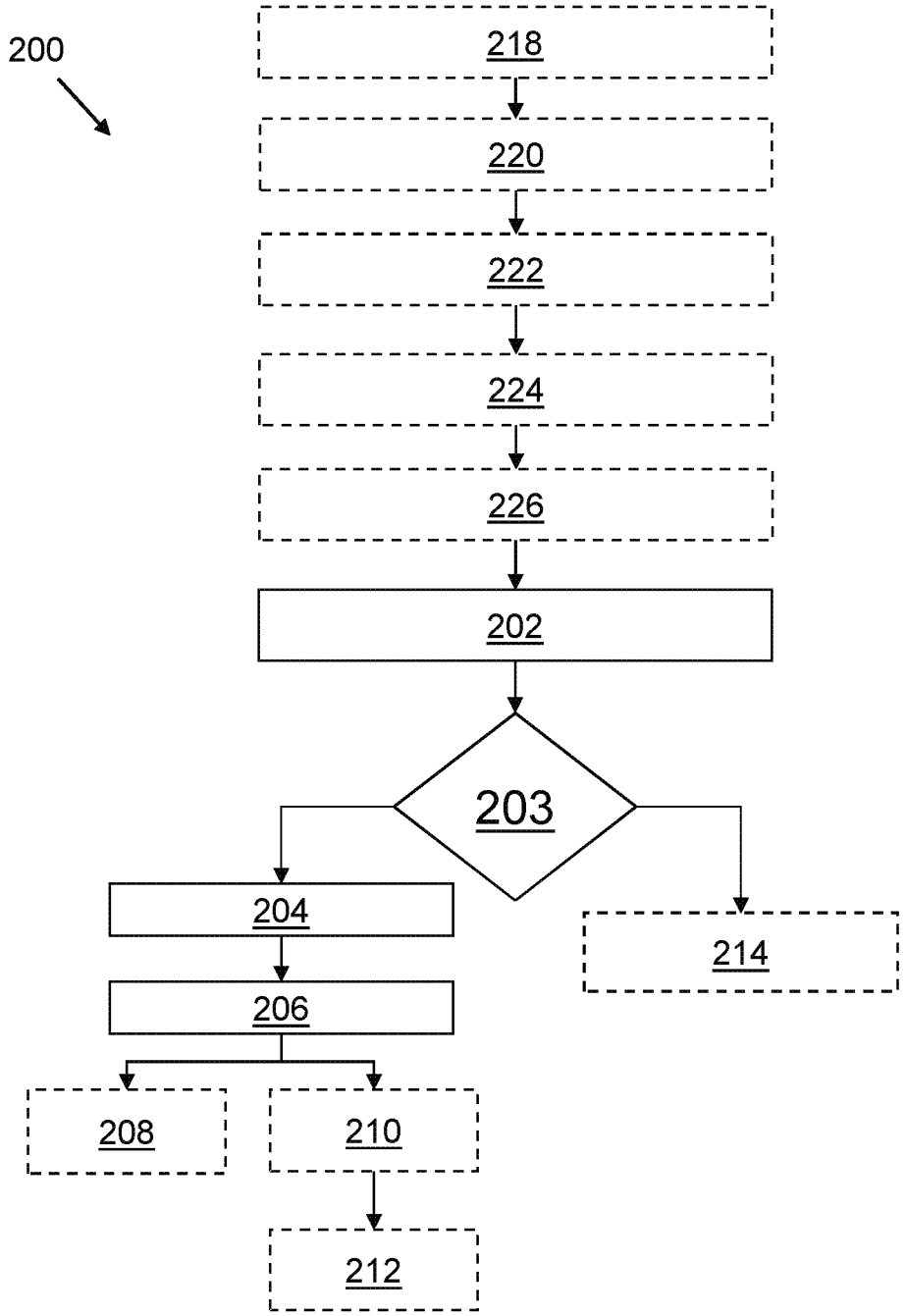
FIG. 4 shows a flow chart of a method in accordance with the present disclosure.

FIG. 4 shows a method 200 of using a cartridge comprising ferrite powder, for example the cartridge of FIGS. 1, 2 and/or 3 above, against a system comprising electric and/or electronic circuitry, including at least one electric motor, for example the system of FIG. 5 below. Optional steps are depicted in dashed line boxes in FIG. 4. On firing, the ferrite powder forms 202 a kinetic-effect column. The way in which the method continues depends on whether the kinetic-effect column hits 203 the targeted system. If the kinetic-effect column hits the system, the kinetic-effect column penetrates 204 the system, for example by fracturing and/or piercing a housing of the system. Once inside, the ferrite powder 110 disperses and disrupts 206 operation of the electrical and/or electronic circuitry within the system. Optionally, the ferrite powder shorts 208 electrical and/or electronic circuitry, for example when the ferrite powder settles on the circuitry, e.g. a circuit board. Optionally, the ferrite powder is attracted 210 to a magnet of an electric motor (or some other component of the motor), and accumulates 212 in the air gap of the motor where in inhibits and/or prevents rotation from the motor. Optionally, in the case that the kinetic-effect column does not hit the targeted system, the ferrite powder disperses 214 as a non-lethal cloud. Returning to the beginning of the method, optionally, the gun is fired 218, for example by a user pulling a trigger, or a trigger signal received from a control system. This causes a firing pin (not shown) to strike and detonate 220 the primer (in the conventional manner), which in turn ignites 222 the propellant, pushing 224 the wad and the ferrite powder along the barrel until they are ejected 226 from the muzzle. Once ejected 226, the ferrite powder initially forms 202 the kinetic-effect column.

Without wishing to be bound by theory, it is believed that as a result of the acceleration of the cartridge along the barrel, the ferrite powder 110 is compressed together. As a consequence of this, it forms a relatively compact mass as it exits the barrel and can thereby provide kinetic effects up to and including the distance $X_1$. In contrast to, for example, conventional shot, the relatively low mass of the particles making up the ferrite powder allows the powder to disperse as a non-lethal cloud if the target system is not hit, thereby reducing the risk of collateral damage. Because the ferrite powder is attracted to magnets, the ferrite powder is attracted to, and disrupts operation of, electrical and/or electronic circuitry. In some embodiments where soft-magnetic ferrite powder is used, because the ferrite powder is not itself magnetic, the risk of the powder sticking together is reduced, while allowing the ferrite powder to be attracted to, and disrupt operation of, electrical and/or electronic circuitry. Thus, cartridges and methods in accordance with the present example embodiments may provide multi-effect countermeasures and thereby increased efficiency, while reducing the risk of collateral damage. Additionally and/or alternatively, cartridges and methods in accordance with the present example embodiments may provide effective countermeasures that are mechanically simple and/or relatively low cost.

Figure 5:
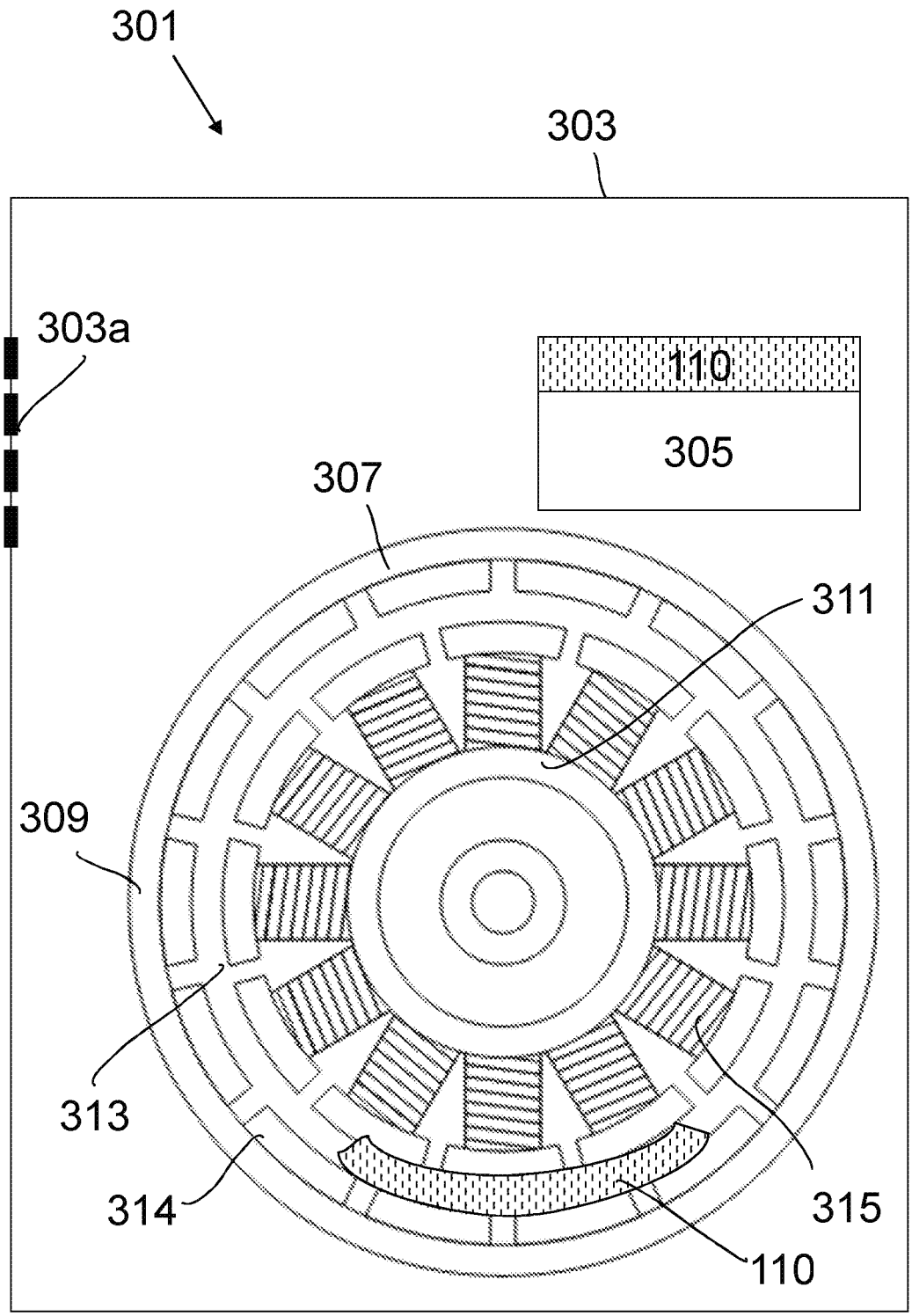
FIG. 5 shows a UAS following use of a method and/or cartridge in accordance with the present disclosure.

FIG. 5 shows a schematic view of a UAS 301 having been subjected to the methods of the present disclosure. The ferrite powder 110 has penetrated UAS 301 by breaching a housing 303 of the UAS 301, resulting in a damaged region 303*a* of the housing 303. The ferrite powder 110 has dispersed within the housing 303. Some of the ferrite powder 110 has settled on the control circuitry 305 of the UAS 301 which is contained within the housing 303. The housing 303 also contains a motor 307. The motor 307 comprises a rotor bell 309 and a stator 311, concentrically located within rotor bell 309, with rotor bell 309 and stator 311 being separated by a small air gap 313. The rotor bell 309 comprises permanent magnets 314 facing inward towards the stator 311, and spaced apart around the circumference of the rotor bell 309. The stator 311 comprises a plurality of windings 315. The skilled person will appreciate that other motor designs are possible. The ferrite powder 110 having been dispersed in the housing 303, has been attracted to, and accumulated on, the permanent magnets 314. The ferrite powder 110 has partially filled the air gap 313 and thereby physically obstructs the rotation of the rotor bell 309 relative to the stator 311. In some cases, the build-up of ferrite powder 110 entirely blocks rotation of the motor. In other cases, the motor may be configured to automatically shut down in the event of an arrested rotation of the rotor bell 309 in order to prevent damage to the windings 315 by excessive electric currents. In such cases, the ferrite powder 110 need not entirely block rotation, and instead needs only to sufficiently impede rotation so as to trigger the automatic shutdown.

Whilst the present disclosure has been described and illustrated with reference to particular embodiments, it will be appreciated by those of ordinary skill in the art that the disclosure lends itself to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as preferable, advantageous, convenient or the like are optional and do not limit the scope of the independent claims. Moreover, it is to be understood that such optional integers or features, whilst of possible benefit in some embodiments of the disclosure, may not be desirable, and may therefore be absent, in other embodiments.

The invention claimed is:

1. A method for disrupting the operation of a system comprising electrical and/or electronic circuitry, wherein the method comprises the steps of;

firing a cartridge containing ferrite powder from a gun; and then, the ferrite powder forms a kinetic-effect column that penetrates the system thereby causing physical damage; and then, the ferrite powder disperses within the system to disrupt operation of the electrical and/or electronic circuitry.

2. A method according to claim 1, wherein the cartridge comprises a wad, and the wad remains with the ferrite powder throughout flight of the wad.

3. A method according to claim 2, wherein the shape and/or configuration of the wad remains the same throughout flight of the wad.

4. A method according to claim 1, wherein disrupting operation of the electrical and/or electronic circuitry comprises one or more of (i) the ferrite powder shorting electrical and/or electronic circuitry, and (ii) the ferrite powder being attracted into an electric motor of the system.

5. A method according to claim 1, wherein the kinetic-effect column penetrates the system at a distance of at least 2 meters from a muzzle of the gun.

6. A method according to claim 1, wherein the cartridge comprises and/or contains one or more reactive agents mixed with the ferrite powder, and said one or more reactive agents are ignited on firing and/or on impact with said system and thereby provide a pyrotechnic effect.

7. A method according to claim 6, wherein the reactive agent is magnesium, aluminum and/or zirconium.

8. A method according to claim 1, wherein in the event that the ferrite powder misses said system, it disperses as a non-lethal cloud.

9. A method according to claim 1, wherein said system is an Uncrewed Air System (UAS).

10. A cartridge, the cartridge containing ferrite powder and being configured such that when fired from the muzzle of a gun, the cartridge produces, at a first predetermined distance from the muzzle, a kinetic-effect column of the ferrite powder for penetrating a system; and then at a point beyond said first predetermined distance the ferrite powder disperses as a non-lethal cloud.

11. A cartridge according to claim 10, wherein the first predetermined distance is at least 2 meters.

12. A cartridge according to claim 10, wherein said point beyond said first predetermined distance is at a distance of at least 10 meters from the muzzle.

13. A cartridge according to claim 10, wherein the cartridge is a shotgun cartridge or a grenade-launcher cartridge.

14. A cartridge according to claim 10, wherein the kinetic-effect column is a mass of said ferrite powder, said mass being substantially cylindrical and having a substantially planar front face.

15. A cartridge according to claim 10, wherein the ferrite powder comprises ferrite particles having a diameter equal to or less than 0.4 mm.

16. A cartridge according to claim 10, wherein the cartridge comprises magnesium, aluminum, zirconium, or colored particles, mixed with the ferrite powder.

17. A cartridge according to claim 10, wherein the cartridge comprises a wad and the ferrite powder is received within a recess defined, at least in part, by the wad.

18. A cartridge according to claim 17, wherein the wad is configured to maintain substantially the same shape and/or configuration throughout flight, for example, the wad comprises a base and at least one sidewall and the wad is configured such that the, or each, sidewall and/or parts thereof, do not move relative to the base throughout flight of the wad.

19. A kit for use in disrupting the operation of a system comprising electrical and/or electronic circuitry, the kit comprising:

a gun comprising a barrel;

a cartridge according to claim 10, being suitable for firing from the barrel of the gun.

20. A kit according to claim 19, wherein the barrel has a bore, the bore has a diameter and the diameter of the bore varies with distance along the length of the barrel such that when fired from a muzzle of the gun, the cartridge produces, at a first predetermined distance from the muzzle, a kinetic-effect column of the ferrite powder for penetrating a system.

* * * * *